US005127305A

United States Patent [19]

Saito

[11] Patent Number: 5,127,305

[45] Date of Patent: Jul. 7, 1992

[54] APPARATUS FOR REPRODUCING MUSICAL PERFORMANCE DATA COMPENSATED BY A JUST-BEATED

[75] Inventor: Tsutomu Saito, Iwata, Japan

[73] Assignee: Kabushiki Kaisha Kawai Gakki Seisakusho, Shizuoka, Japan

[21] Appl. No.: 677,423

[22] Filed: Mar. 29, 1991

[30] Foreign Application Priority Data

Mar. 30, 1990 [JP] Japan ..... 2-84579

[51] Int. Cl.[5] ..... G10H 1/40; G10H 7/00

[52] U.S. Cl. ..... 84/636; 84/DIG. 12

[58] Field of Search ..... 84/612, 636, 652, 668, 84/714, DIG. 12

[56] References Cited

U.S. PATENT DOCUMENTS 3,787,601 1/1974 Campbell ..... 84/DIG. 12
4,018,131 4/1977 Cannon ..... 84/DIG. 12
4,361,066 11/1982 Jones ..... 84/DIG. 12

*Primary Examiner*—Stanley J. Witkowski

[57] ABSTRACT

A musical performance data reproduction appparatus for reproducing stored performance data compensated with a just-beat function. A clock generator generates a clock proportional to a given tempo. A clock counter counts the clock to output incremental clock data. A clock converter converts the incremental clock data into reproduction clock data with a nonuniform increasing rate. The performance data is then reproduced based on the nonuniform reproduction clock data and a time base of the reproduced performance data is expanded/compressed so that reproduced tones are just-beated with respect to a reference beat time.

9 Claims, 10 Drawing Sheets

APPARATUS FOR REPRODUCING MUSICAL PERFORMANCE DATA COMPENSATED BY A JUST-BEATED

BACKGROUND OF THE INVENTION

1. Field of the Invention

The present invention relates to a reproduction apparatus for performance data, which performs an automatic performance (reproduction) on the basis of performance data stored in a storage medium.

2. Description of the Prior Art

In some electronic musical instruments, operation states (numbers of operated keys and switches, ON- and OFF-key timings, ON-key speeds, strengths, and the like) of a keyboard (keys), panel switches, and the like are stored, and in a reproduction mode, operations of keys and panel switches are electrically reproduced on the basis of reproduction data, thus allowing an automatic performance of a music piece. Such an electronic musical instrument is also called an automatic performance apparatus, and can reproduce and play performance data prestored in a commercially available storage medium (a floppy disk or ROM).

Some automatic performance apparatuses of this type have a function of forcibly correcting errors of performance data on the time base, e.g., offsets among notes in a chord performance. Such a function is called a just-beat function or a quantize function.

The just-beat function is realized by a computer program for rewriting time parameters (e.g., ON-key timings) of stored performance data in a conventional apparatus. This program corrects time parameters in performance data to attain a just-beat. When the corrected performance data are read out at a predetermined read speed, a just-beated reproduction performance in which errors on the time base are minimized can be made.

In the conventional apparatus, as described above, since each performance is just-beated by the computer program, just-beat processing must be performed before reproduction, and real-time processing for making a just-beat reproduction performance immediately after recording of a performance cannot be performed.

When time parameters are corrected by the just-beat function, original data cannot be restored, and it is difficult to re-correct data at a different degree (ratio) of correction, or to re-correct data just-beated in units of quarter notes to data just-beated in units of eighth notes. In order to reset just-beat parameters, original performance data must be stored without being corrected, and just-beat processing is performed for a copy of performance data, resulting in a cumbersome procedure.

SUMMARY OF THE INVENTION

The present invention has been made in consideration of the above situation, and has as its object to provide a reproduction apparatus which can execute just-beat processing in real time while reproducing data without rewriting performance data, and can change just-beat parameters during a reproduction performance.

A reproduction apparatus for performance data according to the present invention is an apparatus for reproducing stored performance data, and comprises a clock generation means 1 for generating a clock CK proportional to a reproduction tempo, a clock count means 2 for counting the clock to form incremental clock data CKL and a clock conversion means 3 for receiving the incremental clock data to form reproduction clock data CKN whose rate of increase is nonuniform. Thus, the apparatus reproduces the performance data on the basis of the reproduction clock data.

Since the reproduction clock data has a nonuniform changing rate with respect to the incremental clock data, the time base of performance data to be reproduced based on the reproduction clock data is expanded/compressed with respect to an original performance. For example, a reproduction time base is compressed before and after a reference time such as a beat, and the time base is expanded in other sections, so that timings of performance data which include errors on the time base are corrected in a direction to be concentrated in the reference time (beat). Thus, a just-beat (quantized) reproduction performance can be attained.

Figure 1:
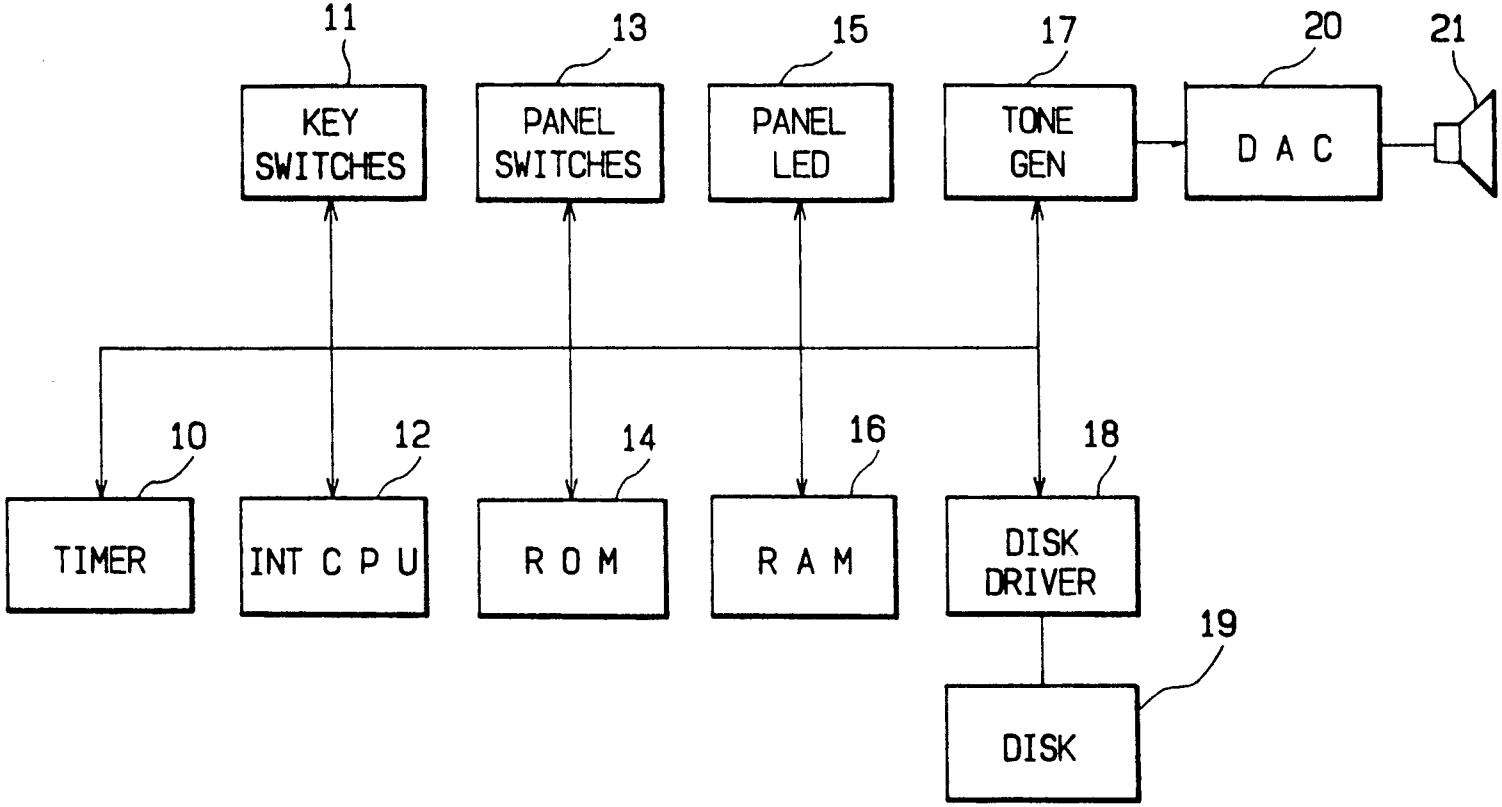
FIG. 1 is a block diagram of an electronic musical instrument according to an embodiment of the present

DETAILED DESCRIPTION OF THE PREFERRED EMBODIMENT:

FIG. 1 is a block diagram of an electronic musical instrument comprising an automatic performance apparatus according to an embodiment of the present invention.

The electronic musical instrument comprises key switches 11 corresponding to a keyboard, and panel switches 13 for setting performance parameters such as a tone color, tempo, and the like, as operation means. Operations of the key switches 11 and the panel switches 13 are detected by a key scan routine of a CPU 12, and switch operation data representing, e.g., numbers of operated keys and panel switches, ON- and OFF-key timings, ON-key strengths, and the like are stored in registers in the CPU, and a RAM 16.

The CPU 12 sends musical tone control signals corresponding to the above-mentioned switch operation data to a tone generator 17 in an output routine. The tone generator 17 comprises a plurality of tone generation channels for generating PCM tone signals corresponding to a piano, a violin, and the like, and forms tone signals having predetermined frequencies, waveforms, amplitudes, sustain times, and the like on the basis of the tone control signals from the CPU 12. The tone signals are converted into analog audio signals by a D/A converter (DAC) 20, and are reproduced by a loudspeaker 21.

The key scan routine and the output routine are executed by a main processing program written in a ROM 14. The CPU 12 ON/OFF-controls a panel LED 15 in correspondence with operations of the panel switches and values of internal registers. In addition, the CPU 12 transfers performance data stored in the RAM 16 to a disk device 19 via a disk driver 18, thus storing the performance data in, e.g., a floppy disk.

In a reproduction performance mode, the CPU transfers performance data reproduced from the disk device 19 to the RAM 16, and sends automatic performance tone control signals to the tone generator 17 in the above-mentioned output routine. In this manner, tones are automatically reproduced via the tone generator 17, the DAC 20, and the loudspeaker 21 in the same manner as in the performance.

Figure 2:
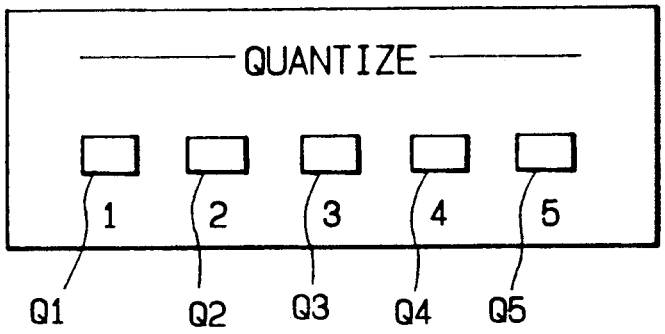
FIG. 2 is a partial view showing some of panel switches shown in FIG. 1.

The panel switches 13 include quantize (just-beat) select switches Q1 to Q5, as shown in FIG. 2. Different just-beat parameters associated with just-beat strengths (expansion/compression ratios of the time base), just-beat units (quarter note unit and eighth note unit), and the like are assigned to these switches. When one or a plurality of the switches Q1 to Q5 are turned on, an automatic performance can be desirably just-beated. Since just-beat parameters can also be set by these switches during a reproduction performance, an operator can determine an optimal just-beat effect while listening to reproduced tones.

Just-beat processing will be described in detail below.

Figure 3:
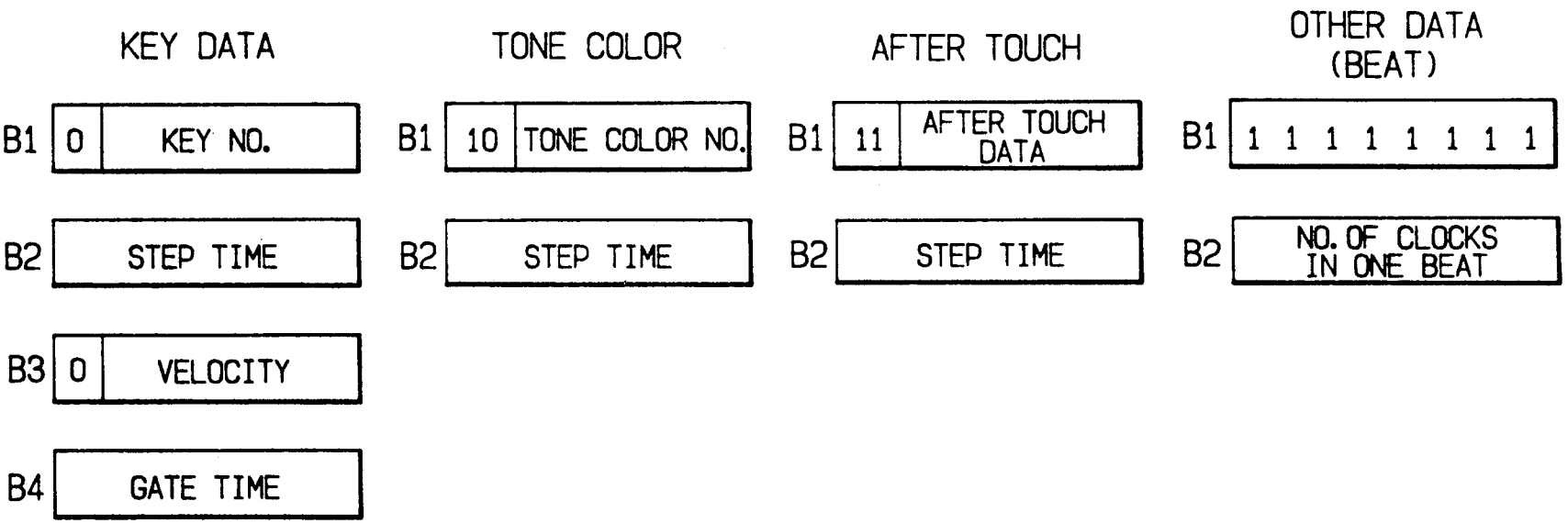
FIG. 3 shows performance data.
Figure 4:
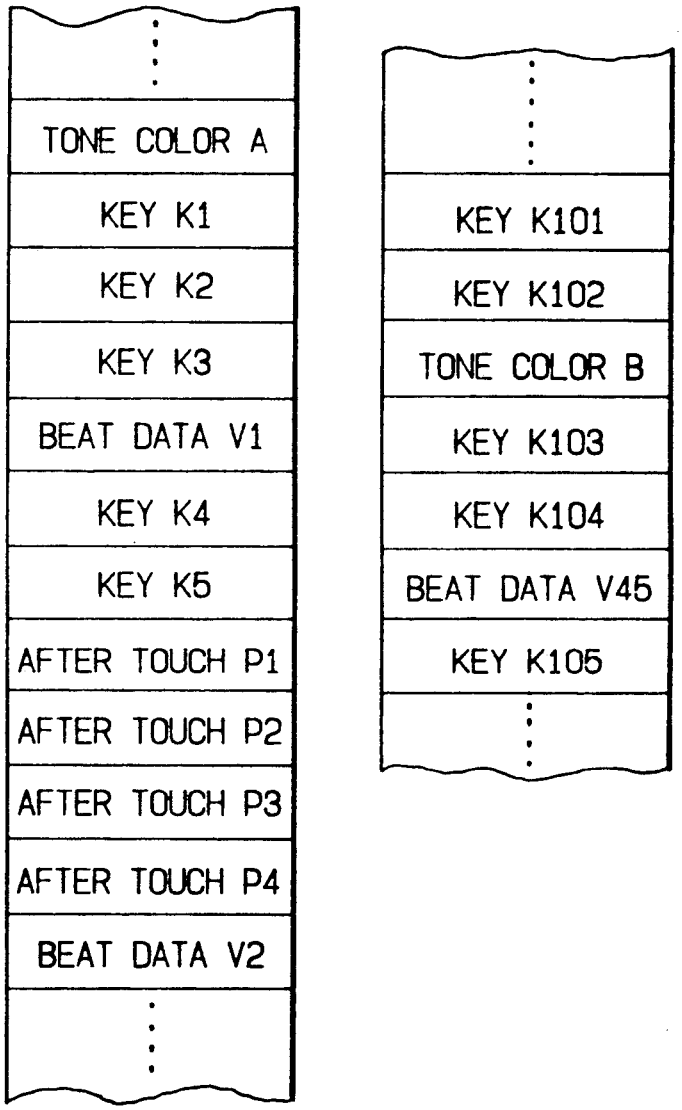
FIG. 4 illustrates an array of a series of stored performance data.
Figure 5:
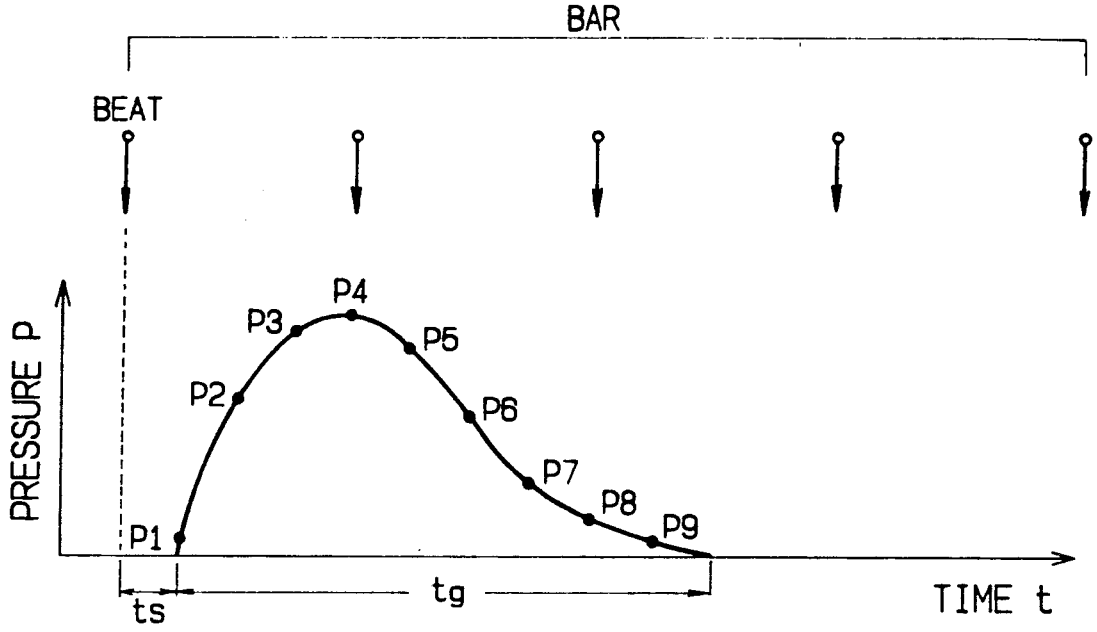
FIG. 5 is a graph showing a change in pressure in a key operation.

FIG. 3 shows types of performance data stored in the RAM 16 or the disk device 19 in FIG. 1, and FIG. 4 shows a recorded array of these performance data. FIG. 5 shows a waveform of a key operation which changes over time.

Key data is constituted by four bytes B1 to B4. The first byte B1 represents a key number, and stores a number of an operated key. The second byte B2 represents a step time, and stores a time $t_s$ from the beginning of each beat in a bar to an ON event of a given key as the number of clocks, as shown in FIG. 5. A clock counts a time at a speed 96 times a quarter note, and is varied in proportion to a tempo speed which is set by one of the panel switches 13. The third byte B3 represents a velocity, and stores an ON-key speed. The ON-key speed corresponds to a rising (attack) time of the key operation waveform shown in FIG. 5. The fourth byte B4 represents a gate time, and stores a time $t_g$ from a key ON event to a key OFF event in FIG. 5 as the number of clocks.

Tone color data is constituted by two bytes B1 and B2. The first byte B1 represents a tone color number, and stores a number of a tone color set by one of the panel switches 13. The second byte B2 represents a step time, and stores a time from the beginning of a beat to an event of a tone color switch as the number of clocks.

After touch data is constituted by two bytes B1 and B2. The first byte B1 stores a digital value obtained by quantizing data in a direction of an ON-key force P of the key operation waveform shown in FIG. 5 with 64 levels. The second byte B2 represents a step time, and stores a time from the beginning of a beat to a fetch timing of after touch data P1, P2, P3,... as the number of clocks.

As another data, 2-byte beat data is provided. The first byte B1 consists of 8 bits of all "1"s, and this data is written every time a beat is generated at a predetermined time interval determined by a tempo speed. The second byte B2 represents the number of clocks of a beat interval. For example, the second byte B2 stores 96 when a one-four time, a two-four time, a three-four time, or a four-four time is selected, and stores 48 when one of a one-eight time to an eight-eight time is selected. In addition, when a one-two time or a two-two time is selected, the byte B2 stores 192.

As described above, the performance data for each event (key operation) of a performance is managed by clocks in a beat in units of beats so as to be recorded or reproduced. For example, as shown in FIG. 4, when a tone color switch of the panel switches 13 is operated, its tone color number A is stored together with the number of clocks (step time) from a beat to an event timing. Furthermore, when the key switches 11 are depressed in the order of, e.g., keys K1, K2, and K3, their key numbers, step times from a beat to ON events, velocities, and gate times are stored in units of key events. Thereafter, when a timing of the next beat is reached, beat data V1 (all "1"s) and the number of clocks in one beat are stored.

Furthermore, the events of the key switches such as keys K4 and K5 are stored, and when a strong key ON event exceeding a predetermined ON-key pressure is detected at the key K5, after touch data P1, P2, P3, P4,... are stored at sampling intervals of, e.g., 2 m seconds together with step times (the number of clocks from a beat). When the next beat is reached during a key depression, it is stored as beat data V2. In this manner, every time an event (operation) occurs, key data and after touch data within one beat are recorded together with step times while recording beat data at predetermined time intervals.

In a reproduction mode, data are reproduced at, e.g., 96 clocks/beat so that beats can have predetermined time intervals. More specifically, a range of one beat is updated by 96 clocks. Within a range of each beat, the numbers 1 to 96 (clock count values) of the clocks counting a time are compared with step time data, and every time a coincidence is detected, event data such as key data, tone color data, after touch data, and the like are output from the CPU 12 to the tone generator 17. The tone generator 17 generates a tone signal having a frequency, waveform, amplitude, sustain time, and the like determined by this event data.

In the embodiment of the present invention, clock count values which are incremented for each unit time within a range of one beat, as described above, are converted to clock count data having nonuniform intervals, i.e., clock count data with a tempo, which data has a nonuniform rate of increase, and performance data are reproduced on the basis of the converted clock count data. Thus, the reproduction time base can be expanded/compressed, and just-beated reproduced tone signals can be obtained.

Figure 6:
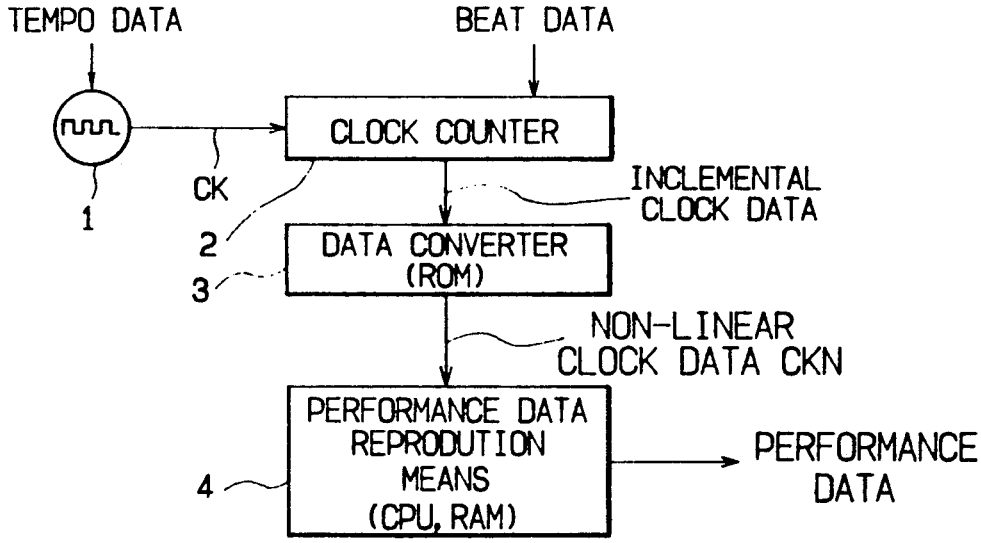
FIG. 6 is a principle block diagram of a performance data reproduction apparatus according to the present invention.

FIG. 6 is a principle block diagram of a performance data reproduction apparatus according to the present invention. A clock generation means 1 receives setup tempo data, and generates a clock proportional to a reproduction tempo. The clock generation means 1 correspond to a timer 10 in FIG. 1, and generates a clock CK at a speed 96 times a quarter note. The clock CK is counted by a clock counter 2, thus forming clock data CKL (linear data) which is incremented like 0, 1, 2, 3, ..., 96. The clock counter 2 is reset when its count value reaches the number of clocks within one beat determined by beat data (FIG. 3), and repeats the above operation. More specifically, the clock counter 2 provides linear time base data within a range of one beat.

Figure 7:
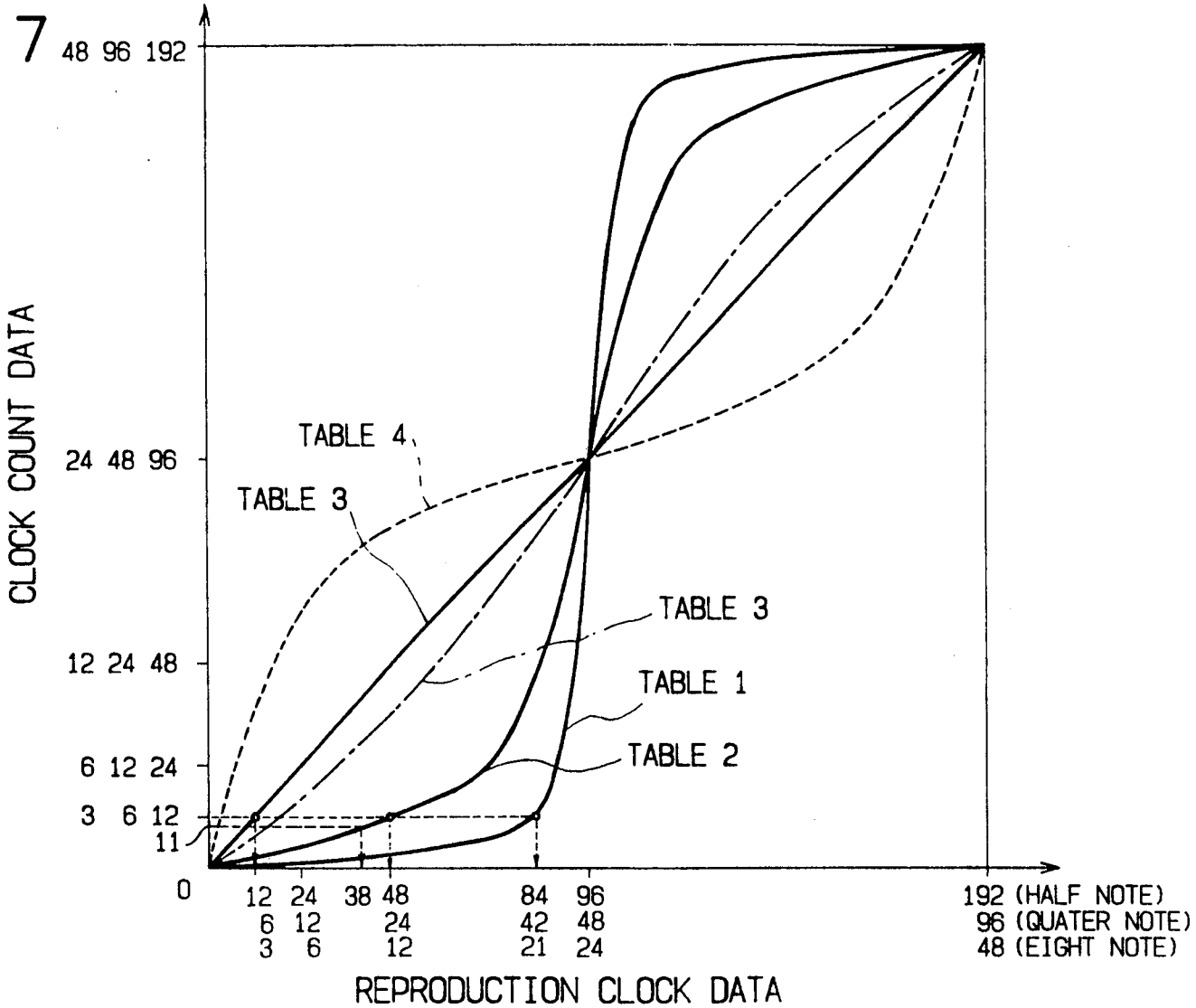
FIG. 7 is a graph showing conversion tables set in a conversion means shown in FIG. 6.

The incremental clock data CKL formed by the clock counter 2 is supplied to a data converter 3, and is converted into clock data CKN (non-linear data) having a nonuniform rate of increase. The converter 3 corresponds to the ROM 14 in FIG. 1, and comprises input (ordinate)-output (abscissa) conversion tables, as shown in FIG. 7. The ordinate of FIG. 7 corresponds to the incremental clock data CKL (clock count data), and is supplied to the ROM 14 as an address input. The ROM 14 stores data according to a non-linear conversion curve shown in FIG. 7 in correspondence with the linear addresses in the form of tables. Thus, reproduction clock data CKN having a non-linear output along the abscissa in correspondence with an input along the ordinate is read out.

The conversion clock data obtained from the converter 3 is supplied to a performance data reproduction means 4 as reproduction clock data. The reproduction means 4 corresponds to the CPU 12 and the RAM 16 in FIG. 1. Every time the reproduction clock data is input, the CPU 12 reads out performance data (event data) having a step time up to the input clock data from the RAM 16. Note that performance data to be reproduced are sequentially transferred from the disk device 19 to the RAM 16.

As a result, a read speed of the performance data can have a tempo according to a conversion curve shown in FIG. 7. A just-beat operation is attained in principle by increasing a read speed of performance data before and after a beat, and decreasing the read speed in the middle of the beat. In order to realize this operation, the conversion curve shown in FIG. 7 has a large rate of change in output reproduction clock data immediately after a count "0" of input clock count data and immediately before a full count, and has a small rate of change at its middle portion. As shown in FIG. 7, a plurality of types of conversion curves are prepared in correspondence with a just-beating amount (strength) based on this principle or performance data to be just-beated.

The just-beated performance data obtained from the reproduction means 4 is supplied to the tone generator 17 in FIG. 1 as a tone control signal.

Figure 8:
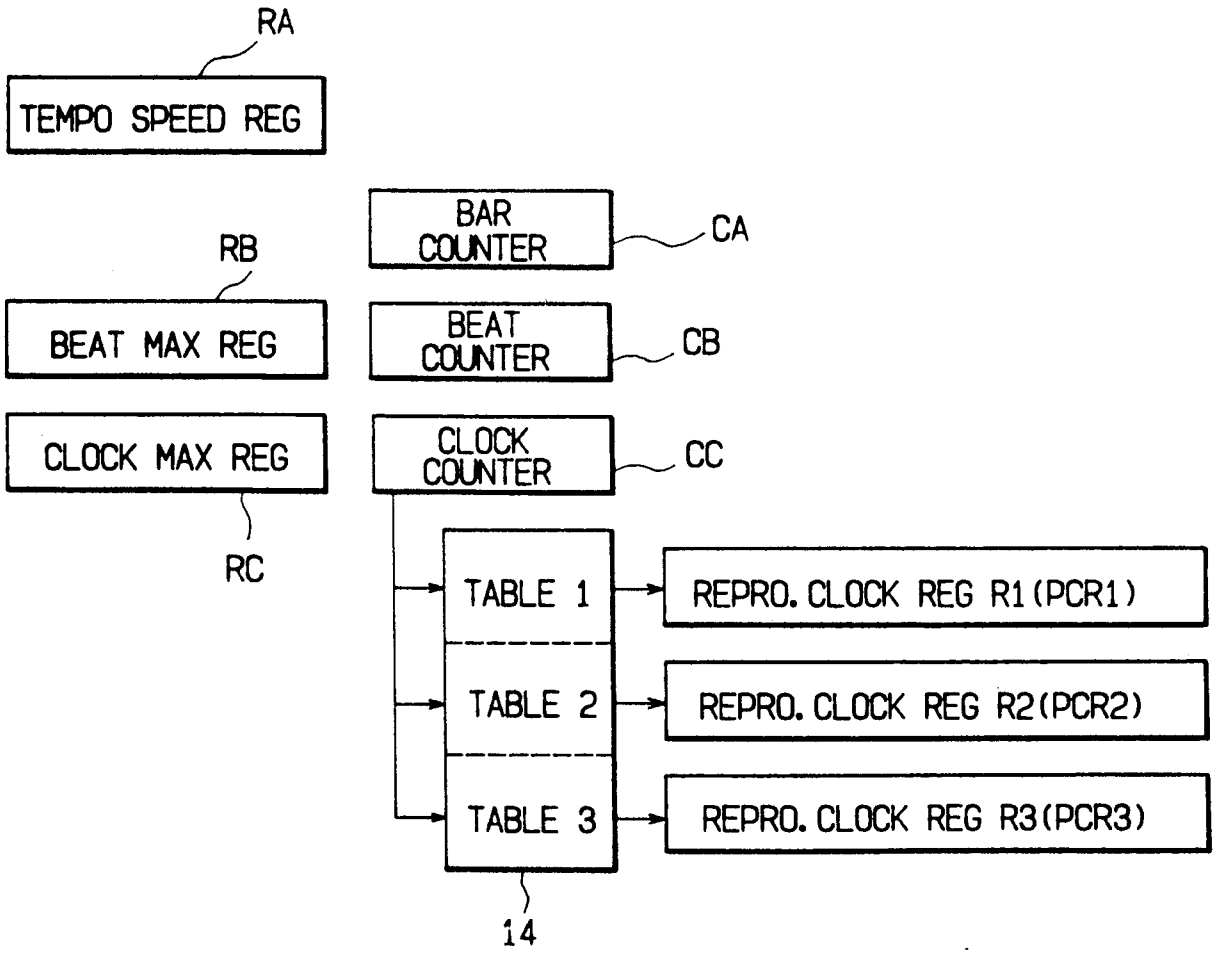
FIG. 8 is a block diagram showing registers and counters for reproduction processing of performance data.
Figure 9:
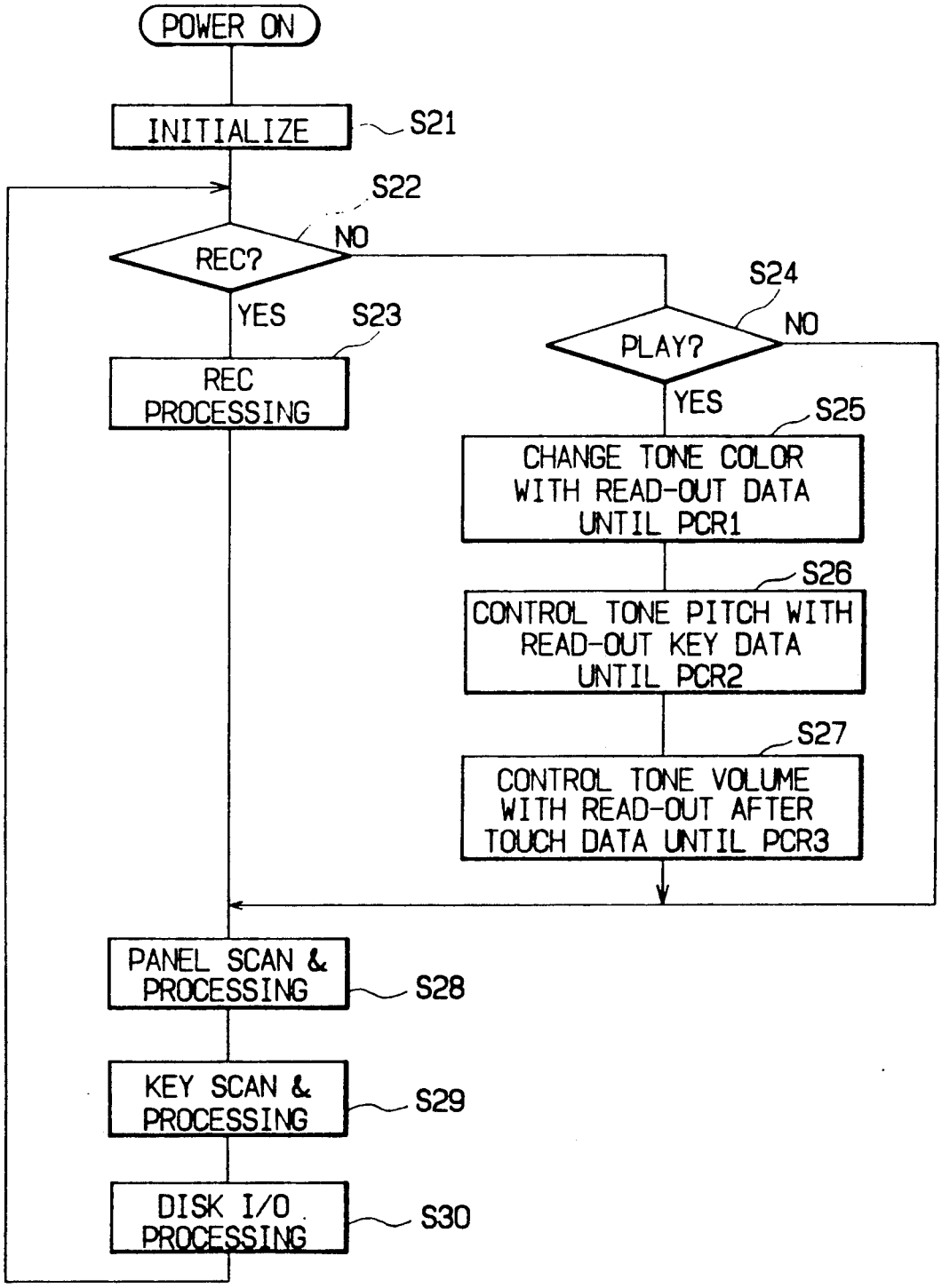
FIG. 9 is a flow chart showing a main routine of a CPU.

The just-beat processing by the CPU 12 will be described in detail below with reference to FIG. 7 showing the conversion tables, FIG. 8 showing an arrangement of registers, and the flow charts of FIGS. 9 and 10 respectively showing the main routine, and the interrupt routine of the CPU.

In FIG. 8, a tempo speed register RA stores tempo speed data set by one of the panel switches 13. A beat MAX register RB stores the number of beats in one bar. For example, if a one-two time is selected, the number of beats is 1; if a four-four time is selected, it is 4; and if a six-eight time is selected, it is 6. A clock MAX register RC stores the number of clocks per beat. For example, if a one-two time is selected, the number of clocks is 192; if a four-four time is selected, it is 96; and if a six-eight time is selected, it is 48. A bar counter CA is counted up by each bar, and stores a number of bar which is presently reproduced. A beat counter CB is counted up by each beat, and stores a number of beat which is presently reproduced. The values of the bar counter CA and the beat counter CB are displayed on the panel LED 15.

A clock counter CC is counted up by each clock, and stores a clock number in a beat which is presently reproduced. The clock counter CC corresponds to the clock counter 2 shown in FIG. 6, and its output is supplied to the ROM 14 storing the conversion table shown in FIG. 7 as an address. Thus, reproduction clock data whose rates of increase are changed according to conversion tables 1, 2, and 3 are respectively stored in reproduction clock registers R1, R2, and R3.

Figure 10:
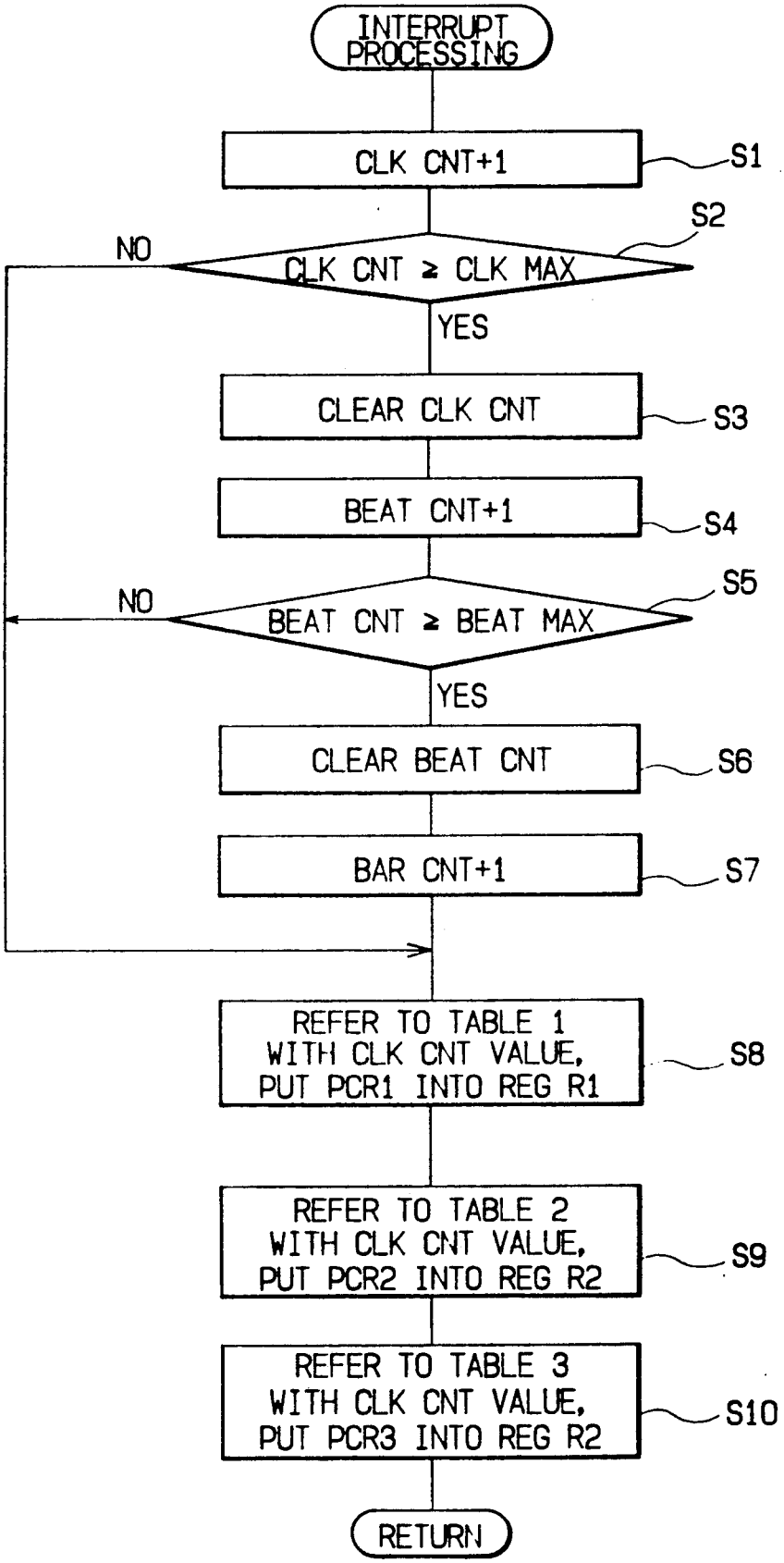
FIG. 10 is a flow chart showing an interrupt routine of the CPU.

The registers RA to RC and R1 to R3, the counters CA to CC, and the ROM 14 are operated as shown in the flow chart of FIG. 10 in cooperation with the CPU 12. FIG. 10 shows interrupt processing for the CPU 12. The interrupt processing is started in response to each clock pulse which is supplied from the timer 10 in FIG. 1 to an interrupt input terminal INT of the CPU 12, and has a speed 96 times a quarter note. The frequency of the clock is increased/decreased in accordance with a tempo speed. For example, when a tempo speed is set to define quarter note=120, an interrupt occurs 11,520 times (120×96) per minute.

When an interrupt occurs, the value of the clock counter CC is counted up by "1" in step S1. In step S2, it is checked if the count value has reached the value (the number of clocks within one beat) of the clock MAX register RC. If YES in step S2, the clock counter CC is cleared in step S3, and the value of the beat counter CB is counted up by "1" in step S4. It is checked in step S5 if the beat counter value has reached the value (the number of beats within one bar) of the beat MAX register RB. If YES in step S5, the beat counter CB is cleared in step S6, and the bar counter CA is counted up by "1" in step S7. The counters CA to CC are sequentially counted up by the above-mentioned processing in steps S1 to S7.

When no count-up processing is performed, i.e., if processing in step S7 is completed, or if NO in step S2 or S5, a series of processing operations in steps S8, S9, and S10 are sequentially executed. In steps S8 to S10, the tables 1, 2, and 3 are referred to based on the value of the clock counter CC to obtain corresponding reproduction clock data PCR1, PCR2, and PCR3, and these data are respectively stored in the reproduction clock registers R1, R2, and R3.

The tables 1, 2, and 3 shown in FIG. 7 are prepared to just-beat time parameters (step times) of tone color data, key data, and after touch data at proper strengths. An expansion/compression ratio of the time base caused by the just-beat processing is largest in the table 1, is medium in the table 2, and is almost zero (linear) in the table 3. For example, since a proper just-beat effect is required for key data, the table 2 is used. As for tone color data, since it is unnatural to change a tone color in the middle of a beat, the table 1 having a strong just-beat effect is used. When after touch data is just-beated since tones become discontinuous and flutter by just-beat processing, the table 3 equivalent to non-conversion is used. Note that, as indicated by an alternate long and short dashed curve in FIG. 7, a table 3' for slightly expanding/compressing the time base may be assigned to after touch data.

With the tables 1 and 2 described above, the time base is compressed before and after a beat, and is expanded in the middle of the beat, thereby obtaining a just-beat (quantize) effect. As shown in a table 4 indicated by a dotted curve in FIG. 7, reverse just-beat processing may be performed by expanding the time base before and after a beat, and compressing the time base in the middle of the beat. In the reverse just-beat processing using the table 4, performance data having errors (variations) on the time base before and after a beat are reproduced to be scattered in a direction to be separated from the beat. More specifically, reproduced tones having large errors on the time base with respect to beats are obtained.

The tables 1 to 3 are referred to in steps S8 to S10 in FIG. 10 as follows. For example, if a beat is a half note, and the value (clock count data) of the clock counter CC plotted along the ordinate of FIG. 7 is 12, when the table 1 is referred to, reproduction clock data along the abscissa is 84. Thus, this value PCR1 is stored in the reproduction clock register R1. Similarly, when the table 2 is referred to, since the reproduction clock data is 48, this value PCR2 is stored in the reproduction clock register R2. Furthermore, when the table 3 is referred to, since the reproduction clock data is 12, this value PCR3 is stored in the reproduction clock register R3.

Note that the values of these reproduction clock data are halved every time a beat is changed to a quarter note or an eighth note. In the tables in FIG. 7, only conversion data for a given beat, e.g., a half note, may be formed, and for other beats, read-out conversion data obtained by referring to the table may be arithmetically shifted (left or right shift).

Read processing of performance data based on the reproduction clock data converted by the tables shown in FIG. 7 will be described below with reference to the main routine of the CPU shown in FIG. 9.

When a power switch is turned on, initialization is performed in step S21. In this step, the RAM 16, the tone generator 17, the panel LED 15, the timer 10, and the like shown in FIG. 1 are initialized. In step S22, it is checked if a recording mode (REC) is selected. If YES in step S22, recording processing is executed in step S23.

However, if NO in step S22, the flow advances from step S22 to step S24 to check if a reproduction mode (PLAY) is selected. If YES in step S24, performance data read processing operations in steps S25 to S27 are sequentially executed. In step S25, processing is performed for tone color data, and tone color data having step times up to the present value PCR1 of the reproduction clock register R1 are read out. When the tone color data are sent from the CPU 12 to the tone generator 17, tone colors of tones to be generated are changed.

In step S26, processing is performed for key data, and all the key data having step times up to the present value PCR2 of the reproduction clock register R2 are read out. The read-out data are sent from the CPU 12 to the tone generator 17. The key data consists of a key number, a velocity, and a gate time, as shown in FIG. 3, and a frequency, waveform, attack time, sustain time, and the like of a tone to be generated are controlled by these parameters. For example, in FIG. 7, when clock count data (ordinate) is counted up from 11 to 12, since reproduction clock data along the abscissa according to the table 2 is changed from 38 to 48, key data having time parameters (step times) included in this interval are simultaneously read out.

For example, if the key data K1 and K2 shown in FIG. 4 have step times between 38 to 48 of the reproduction clock data, it is considered that these data have a step time represented by the 48th clock of the reproduction time base, and these data are simultaneously read out. More specifically, the reproduction time base is compressed. These key data K1 and K2 are reproduced to be separated from each other along the time base in accordance with their step times if they are not just-beated.

In step S27, processing is executed for after touch data, and after touch data having step times up to the present value PCR3 of the reproduction clock register R3 are read out. The read-out data are sent to the tone generator 17. The read-out after touch data are used in tone volume control.

Upon completion of the above-mentioned processing, scan processing for detecting events at the panel switches 13 and the key switches 11 is executed in steps S28 and S29. In step S30, I/0 (recording/reproduction) processing of performance data to/from the disk device 19 is performed, and the flow then returns to step S22.

Figure 11:
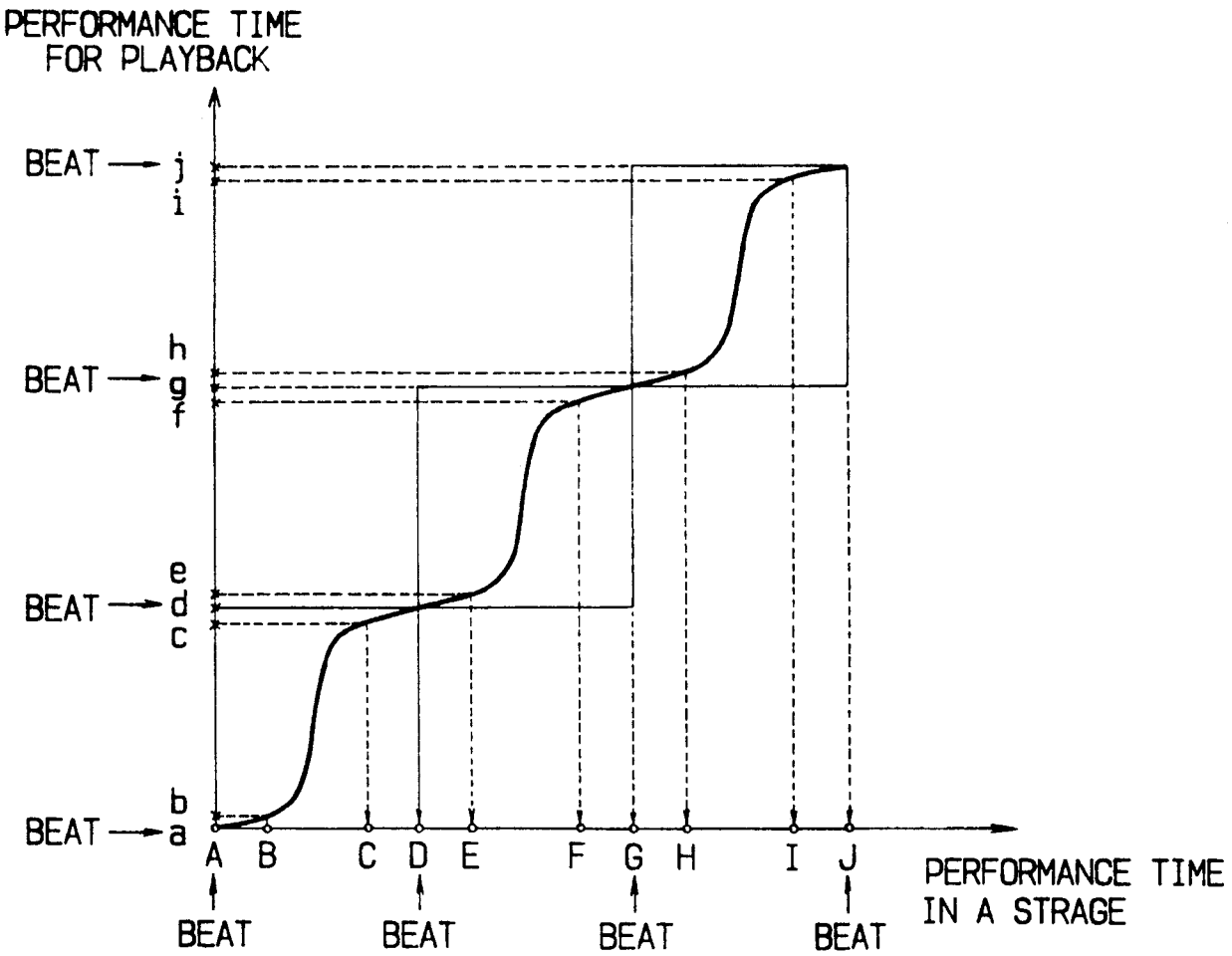
FIG. 11 is a graph showing performance data and their reproduction timings along the time base.

FIG. 11 shows reproduction timings of performance data when the above-mentioned quantize processing is performed. A, B, C,..., J along the abscissa of FIG. 11 represent time parameters (step time data) stored together with performance data, and a, b, c,..., j along the ordinate represent time parameters of performance data which are reproduced based on converted reproduction clocks. Data A-a, D-d, and G-g of the respective axes are located at beat positions in this case. The stored time parameters are located at time-serially separated positions on both sides of each beat position (D, G) like C and E, and F and H. On the other hand, as can be seen from FIG. 11, when just-beat processing for reading out data based on converted reproduction clock data is performed, corresponding data c and e, and f and h are read out to be concentrated near corresponding beat positions (d, g). That is, performance data including errors on the time base are converted to just-beat data, and the just-beat data are reproduced.

For example, if the time parameters C, D, and E correspond to a chord performance, they are reproduced at almost the same time like c, d, and e as a result of the just-beat processing.

The embodiment of the present invention has been fully described above. However, the embodiment may be variously modified based on the technical concept of the invention. For example, the conversion tables shown in FIG. 7 are expressed by non-linear curves, but may be expressed by polygons. In the above embodiment, the conversion tables are realized by the ROM 14. If the CPU has a sufficient processing speed, incremental clock data may be converted to reproduction clock data using a simple arithmetic step corresponding to a non-linear curve.

According to the present invention, as described above, since performance data are reproduced on the basis of reproduction clock data having a nonuniform rate of increase, the reproduction time base can be expanded/compressed. Therefore, errors of stored performance data can be corrected toward, e.g., a reference time in units of beats. Thus, an array of performance data, which are varied along the time base can be rearrayed (can be converted to just-beat data). Since the expansion/compression processing of the time base is performed by converting count data of given clocks into reproduction clocks having a nonuniform rate of increase, processing can be performed in real time without executing processing for rewriting time parameters of performance data like in a conventional apparatus. The expansion/compression ratio of the time base can be easily changed even during a reproduction performance.

According to the present invention, stored performance data can be immediately subjected to time base processing, and a reproduction performance having various acoustic effects can be made by changing the expansion/compression ratio of the time base.

What is claimed is:

1. An apparatus for reproducing performance data, comprising:

random access memory for storing the performance data;

clock generation means for generating a clock proportional to a reproduction tempo;

clock count means for counting the clock and for producing incremental clock data;

clock conversion means for receiving the incremental clock data and for producing reproduction clock data having a nonuniform rate of increase;

error correcting means for correcting errors in the stored performance data, in real time, by expanding or compressing the reproduction clock data having a nonuniform rate of increase, thereby converting the stored performance data into just-bat data; and reproduction means for reproducing the just-beat data in order to generate a musical tone.

2. The apparatus of claim 1, wherein said clock conversion means includes memory means for storing a conversion table representing a relationship between the incremental clock data and the reproduction clock data.

3. The apparatus of claim 1, wherein said clock conversion means includes a plurality of conversion tables, each representing a relationship between the incremental clock data and the reproduction clock data, said plurality of conversion tables being selectively utilized depending upon the performance data or a reproduction mode.

4. The apparatus of claim 1, wherein the performance data includes event data representing a key depression, and a time parameter representing an operation timing measured from a reference table, and said reproduction means sequentially reading out the event data having time parameters smaller than the reproduction clock data.

5. The apparatus of claim 4, wherein the reference time is a beat of a performance, which is generated at a predetermined time interval, the performance data is divided in units of beats and includes at each division position, data representing a beat and data representing the number of clocks during one beat period, and said clock count means cyclically counts the clock in units of beats.

6. The apparatus of claim 1, wherein the nonuniform rate of increase in the reproduction clock data is large at the beginning and the end of a predetermined cyclic count period of said clock count means, and is small in the middle of the predetermined cyclic count period.

7. The apparatus of claim 1, wherein the nonuniform rate of increase in reproduction clock data corresponding to the incremental clock data is small at the beginning and the end of a predetermined cyclic count period of said clock count means, and is large in the middle of the predetermined cyclic count period.

8. The apparatus of claim 6, wherein an intermediate value and an end value of the incremental clock data in the predetermined cyclic count period of said clock count means respectively coincide with corresponding values of the reproduction clock data, the reproduction clock data is advanced from the incremental clock data from a beginning of the incremental clock data to the intermediate value, and the reproduction clock data is delayed from the incremental clock data from the intermediate value to the end value.

9. The apparatus of claim 7, wherein an intermediate value and an end value of the incremental clock data in the predetermined cyclic count period of said clock counts means respectively coincide with corresponding values of the reproduction clock data, the reproduction clock data is delayed from the incremental clock data from the beginning of the incremental clock data to the intermediate value, and the reproduction clock data is advanced from the incremental clock data from the intermediate value to the end value.

* * * * *